US012590398B2

(12) United States Patent
Milz et al.

(10) Patent No.: US 12,590,398 B2
(45) Date of Patent: Mar. 31, 2026

(54) WATER BEARING APPLIANCE, CONTROL METHOD, AND SYSTEM

(71) Applicant: E.G.O. Elektro-Geraetebau GmbH, Oberderdingen (DE)

(72) Inventors: Christoph Milz, Fairfield, CA (US); Uwe Schaumann, Oberderdingen (DE); Antonio Di Maggio, Schwaigern (DE); Juergen Eiselt, Illertissen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 520 days.

(21) Appl. No.: 18/053,817

(22) Filed: Nov. 9, 2022

(65) Prior Publication Data

US 2024/0150953 A1 May 9, 2024

(51) Int. Cl.
*D06F 39/08* (2006.01)
*D06F 39/02* (2006.01)
(Continued)

(52) U.S. Cl.
CPC ..... *D06F 39/088* (2013.01); *D06F 39/02* (2013.01); *D06F 39/10* (2013.01); *A47L 15/0049* (2013.01);
(Continued)

(58) Field of Classification Search
CPC ..... D06F 34/14; D06F 39/088; D06F 33/43; D06F 39/02; D06F 39/10; D06F 2103/00;
(Continued)

(56) References Cited

U.S. PATENT DOCUMENTS

2013/0022455 A1 1/2013 Weber et al.
2016/0215430 A1 7/2016 Ha et al.
(Continued)

FOREIGN PATENT DOCUMENTS

CN 112896108 A 6/2021
CN 114488829 A 5/2022
(Continued)

OTHER PUBLICATIONS

International Searching Authority, International Search Report and Written Opinion received for International Application No. PCT/EP2022/082997, dated Oct. 17, 2023, 27 pages, European Patent Office, Netherlands.

*Primary Examiner* — Benjamin L Osterhout
(74) *Attorney, Agent, or Firm* — ALSTON & BIRD LLP

(57) ABSTRACT

A water bearing appliance, control method, and system are provided. Operating data from appliances are transmitted to a receiver over a network such as the Internet. Maintenance, cleaning, and repairs are initiated based on the operating data, and can be triggered remotely and automatically. A machine learning model(s) is trained according to operating conditions of various appliances and respective outcomes, such as maintenance, repairs, damages, life expectancy, and/or the like, to learn correlations therebetween. A digital twin appliance data object is generated for an appliance and applied to the machine learning model(s) to provide a predictive maintenance data object. Cleaning regimens, maintenance, repairs, and/or the like are configured to particular operating circumstances of an appliance.

8 Claims, 6 Drawing Sheets

(51) Int. Cl.

| | |
|---|---|
| ***D06F 39/10*** | (2006.01) |
| *A47L 15/00* | (2006.01) |
| *A47L 15/42* | (2006.01) |
| *D06F 25/00* | (2006.01) |
| *D06F 33/43* | (2020.01) |
| *D06F 34/14* | (2020.01) |
| *D06F 103/00* | (2020.01) |
| *D06F 103/16* | (2020.01) |
| *D06F 103/20* | (2020.01) |
| *D06F 103/70* | (2020.01) |
| *D06F 105/58* | (2020.01) |

(52) U.S. Cl.
CPC ..... *A47L 15/4297* (2013.01); *A47L 2401/11* (2013.01); *A47L 2401/12* (2013.01); *A47L 2401/18* (2013.01); *A47L 2401/22* (2013.01); *A47L 2401/34* (2013.01); *A47L 2501/26* (2013.01); *D06F 25/00* (2013.01); *D06F 33/43* (2020.02); *D06F 34/14* (2020.02); *D06F 2103/00* (2020.02); *D06F 2103/16* (2020.02); *D06F 2103/20* (2020.02); *D06F 2103/70* (2020.02); *D06F 2105/58* (2020.02)

(58) Field of Classification Search
CPC .. D06F 25/00; D06F 2103/20; D06F 2105/58; D06F 2103/70; D06F 2103/16; A47L 15/4297; A47L 15/0049; A47L 2401/22; A47L 2401/34; A47L 2401/12; A47L 2501/26; A47L 2401/11; A47L 2401/18
See application file for complete search history.

(56) References Cited

U.S. PATENT DOCUMENTS

| | | | | |
|---|---|---|---|---|
| 2019/0138970 | A1* | 5/2019 | Deutsch | G06F 9/542 |
| 2019/0163215 | A1* | 5/2019 | Cheng | G05B 15/02 |
| 2020/0018010 | A1 | 1/2020 | Cha et al. | |
| 2020/0277720 | A1 | 9/2020 | Eiselt et al. | |
| 2020/0291564 | A1 | 9/2020 | O'Malley et al. | |
| 2020/0305678 | A1 | 10/2020 | Kessler et al. | |
| 2021/0381152 | A1 | 12/2021 | Belveal et al. | |
| 2021/0398054 | A1 | 12/2021 | Jaggers et al. | |

FOREIGN PATENT DOCUMENTS

| | | | | |
|---|---|---|---|---|
| CN | 114663074 | A | 6/2022 | |
| DE | 102011079510 | A1 | 1/2013 | |
| DE | 102018209688 | A1 | 12/2019 | |
| DE | 102021204201 | A1 | 11/2022 | |
| EP | 3751041 | A1 | 12/2020 | |
| EP | 4233672 | A1 * | 8/2023 | A47L 15/4293 |

* cited by examiner

WATER BEARING APPLIANCE, CONTROL METHOD, AND SYSTEM

TECHNOLOGICAL FIELD

An example embodiment of the present disclosure relates generally to appliances, such as but not limited to a washing machine, a washer dryer, a dishwasher, and/or the like. An example embodiment relates more particularly to an improved appliance, control method, and system thereof.

BACKGROUND

Appliances may have different lifespans and incur different types of damages and problems based on variations in maintenance and cleaning routines, frequency of use, and other operating conditions. Companies that lease out appliances may not be able to track maintenance and cleaning routines, operating conditions and/or frequency of use of the appliance, and therefore may not be able to assess risks with the appliance such as life expectancy, likelihood of damages and/or certain maintenance or repairs needing to be made, and/or the like.

A domestic appliance, for example as a washing machine, includes a treatment chamber, for example a rotating drum, in which pieces of laundry are to be washed and cleaned. A water inlet, a water guide system and a water outlet are provided. Furthermore, functional units such as a pump, a filter and valves are provided in the water guide system. The washing machine has an appliance control having a memory and a communication module connected to the outside, for example connected to the Internet. Various operating programs are stored in the memory.

BRIEF SUMMARY

It is an object of the present disclosure to provide a water bearing appliance, such as a domestic appliance, as well as methods for operating such an appliance effectively and efficiently with more comfort for the user, as well as options for a manufacturer of the appliance to generate data to enhance manufacturing and improve operation of such an appliance.

The water bearing appliance has a treatment chamber, for example in the form of a rotating drum in the case of a washing machine, wherein objects are treated or cleaned in this treatment chamber by means of water. A water inlet into the domestic appliance and a water outlet out of the domestic appliance are provided. A water guide system is provided in the appliance, to which the water inlet and the water outlet are connected or form a part thereof. Furthermore, a device for introducing water into the treatment chamber is provided as well as a chamber outlet out of this treatment chamber. The device for introducing water into the treatment chamber can advantageously be a spraying device, for example with one or several spraying nozzles or spraying arms.

The appliance is also provided with a pump, a filter and a valve which are part of the water guide system and help to guide or distribute and remove water in the appliance where needed. The appliance also has an appliance control which is connected to the valves and to the pump. This appliance control has a processor, a memory, and a communication module, which is designed to communicate with a counter communication module being arranged outside or external to the domestic appliance, for example a Wi-Fi router or Wi-Fi access point or the like, for example in a house. This Wi-Fi access point or router can be connected to a network, such as the Internet, for data transfer in one direction or both directions. In the memory, individual operating data is stored which has been acquired during operation of the appliance. This individual operating data may comprise one or more of the following: number of treatment operations, kind of treatment operations, kind of agents used for a treatment, detergent consumption, kind of laundry to be washed, standstill times of the appliance, kind of laundry to be washed, standstill times of the appliance, detergent consumption, maintenance program for the domestic appliance or the like. The individual operating data may therefore reflect usage of the appliance, care and maintenance performed by the user, soiling degree, stain types, and/or the like. Furthermore, the memory additionally has stored general operating data for the domestic appliance, which general operating data may include at least one of the following: ambient temperature, water hardness and/or softness, (which may include or be associated with a measurement of lime content in the water), water contamination, water temperature of the water let into the domestic appliance or out of it (and/or how many times or frequency of water temperature cycles were run), programs or cycles selected to be run and frequency thereof, geographic location of the appliance, nature of use of the appliance, and/or the like. The general operating data may include data which does not depend on the individual behavior of the user but can be detected and/or sensed by various sensors of the appliance or may be provided from an external data source, such as for example publicly available databases accessed via a network such as the Internet. The general operating data may depend on the place where the appliance is set up. General operating data may be constant, but it may also change, for example within a day or even within minutes such as water temperature if water from solar collectors is used. The nature of use of the appliance is important to know, for example if the appliance is based in a holiday apartment, vacation rental, short term rental and/or the like, where longer periods of a standstill may occur. This needs special care with regard to contamination or biofilms, respectively, which may build up in the appliance during long non-use.

By providing various operating data, in particular individual operating data as well as general operating data of the domestic appliance, which can be transferred via the communication module and over a network such as the Internet to a place where this data is stored and evaluated, it is possible to acquire data that is pertinent to this specific individual appliance. This may serve to service the appliance from the outside, irrespective of whether a user initiates or executes any service operation such as cleaning any parts inside the water guide system, a filter or refill any treatment additives such as detergent, decalcifier or the like. This ensures long life and smooth operation and use of the appliance for the user as well as for the appliance itself. This is described in further detail later on with respect to a method for operating such an appliance in a leasing operation and/or the like.

The valve can be arranged in a water conduit or a water pipe of the water guide system just downstream of the water inlet into the domestic appliance. This serves for closing any water inlet into the appliance for safety reasons on the one hand and for better control of the amount of water being let into the appliance. In certain embodiments, this valve is a two-way valve, which means that the water inlet can simply be closed or opened.

A further valve is preferably arranged in or close to the chamber outlet. This valve may be designed as a two-way valve which simply serves to let water out of the treatment chamber or not. This valve may be located less than 10 cm away from the chamber outlet, and in some embodiments, less than 5 cm away. Both valves described above may either be constructed as a valve that can simply be fully open or fully shut. Alternatively, they may also serve to dose or regulate the amount of water flowing through them to be able to better control the flow of water, and in particular, the valve at the water inlet.

In an embodiment, a valve can be arranged in the water conduit before the water outlet from the domestic appliance, in particular in a conduit between the pump and the water outlet. This valve can be a three-way valve, wherein a first valve outlet leads to the water outlet and a second valve outlet leads to the insertion device into the treatment chamber. Water can therefore either be let out of the appliance in the case of wastewater or let into the treatment chamber for treating what is inside.

In certain embodiments, the filter may be arranged behind the chamber outlet, in particular behind the valve described before. The filter can have a filter inlet being connected to the chamber outlet by means of the valve described before, wherein the filter can have a filter outlet which is connected to the pump by means of a water conduit, preferably connected by means of a further valve. A dosing device for cleaning agents, washing agents, disinfectants or the like can be arranged in the water duct upstream of the pump, in particular between the filter and the pump. The dosing device can have a dosing outlet, which may be connected to a water line or to a pump inlet as described before. A dosing device can be monitored for the consumption of cleaning agents, washing agents, disinfectants or the like being stored therein. The data generated therefrom can also be stored and used further on. An automated dosing of these agents and an automated refilling of the dosing device may be provided, which will be described in further detail herein.

It is possible to arrange a further valve downstream of a pump outlet of the pump, which valve may be a three-way valve. A first valve outlet can be connected to the filter by means of a water line. A second valve outlet can be connected to the water outlet from the domestic appliance by means of a water line.

In an embodiment, the water conduit with the pump and the filter and several valves can be arranged in an independently manageable assembly unit which is arranged below the treatment chamber. In certain embodiments, all the valves except one valve at the water inlet into the domestic appliance can be in this assembly unit. The independently manageable assembly unit can be designed to be movable as an assembly unit in such a way that it can be at least partially pulled out of the domestic appliance. It can be designed and built according to DE 10 2021 204 201 A1, which is hereby incorporated by reference in its entirety. The assembly unit preferably has no rigid water-carrying connection or line to the treatment chamber.

The lines going from the assembly unit to the outside and the lines coming from the outside to the assembly unit can at least partially be variable in length and can be designed as flexible and/or elastic and/or telescopic hoses. These lines need not be fixedly installed at connections or at free ends, they can be flexible and variable in location. The connections preferably can be water couplings that can be manually released, so the assembly unit can be moved out or even removed from the appliance.

A lower side or underside of the assembly unit can extend above an underside of the housing of the water-carrying domestic appliance. According to certain embodiments, the lower side or underside of the assembly unit can extend at most 10 cm above the underside of the housing. Preferably, this lower side or underside corresponds to the underside of the appliance, so the assembly unit can be placed at the lowermost location of the appliance.

In certain embodiments, the assembly unit can be constructed to be movable forward out of the domestic appliance. Such a movement can be a horizontal movement. In particular a rail guide can be provided for the movement and can be used for pulling and moving the assembly unit out of the appliance, and for this the assembly unit can be mounted with the rail guide in the appliance. In certain embodiments, the assembly unit can be extracted at least to 50% of its length in a pulling direction. In certain embodiments, the extraction can be at least to 70%, or even 100%, for example.

In certain embodiments, between the chamber outlet and the valve arranged between the chamber outlet and the filter, a pre-filter may be arranged in the water conduit. This can serve to protect the filter from larger objects that might easily be filtered out, such as socks, coins, or similar objects. This pre-filter can be constructed to be manually cleanable. Furthermore, the pre-filter may be arranged in the assembly unit described above, which can enable access to the pre-filter. In this regard, the assembly unit can be pulled out of the domestic appliance for manual cleaning of the pre-filter.

The communication module can preferably be designed for wireless communication, in particular by means of a method from the group: WLAN, Bluetooth, ZigBee. Such a standard allows for safe and easy communication. Additionally, or alternatively, a cable connection can also be provided, especially if the appliance is to be operated where no such wireless communication is available or sufficiently strong, for example in a basement room.

A method for operating a water-carrying appliance may comprise initiation and/or configuration of general operating data, which applies to the appliance at an installation location, and may be performed determined during or after the initial start-up. This general operating data is stored in the memory of the appliance control or in a receiver connected to the counter-communication module. The general operating data can be recorded either in the domestic appliance itself by means of sensor means present there, or the data can be retrieved from an external data collection. Sensor means may include temperature sensors provided on water lines and heating means. Such an external data collection may be provided over the Internet. The individual operating data is stored, preferably once they have been gathered or recorded, in the memory of the appliance control during operation of the appliance.

The appliance control transmits the general operating data and the individual operating data to a receiver via the communication module by means of a counter-communication module. The operating data is then stored in the receiver and/or associated database in such a way that they are assigned to this specific appliance, such as by serial number or other unique identifier. This allows generation of a digital twin appliance data object, representative of the appliance, such as by the receiver. This digital twin appliance data object can be used to store the information needed to determine when the device needs servicing, such as a repair of any parts or modules, or what potential damage has occurred or is likely to occur within the appliance. The digital twin appliance data object preferably mirrors the physical system of the appliance throughout the entire product lifecycle, during design, manufacturing, operation, and disposal. It is perpetually edited to keep up with the evolving, physical system of the appliance, mainly when it is in use somewhere.

In certain embodiments, the appliance control unit can carry out a cleaning process and/or a hygiene program for the domestic appliance on its own or may be triggered by the receiver. Such a cleaning process or hygiene program may then be determined on the basis of the general operating data and/or of the individual operating data. It can alternatively be triggered by an instigation from outside, such as an end of a leasing period of the appliance, the instigation having been received by means of the communication module and the receiver. A cleaning process may remove biofilms, contamination, or the like anywhere in the appliance. This may be in the pump, in any water line, in a filter as well as in a valve. Hot water can be used for cleaning, which is more environment-friendly than a use of chemicals. But also cleaning agents or disinfectants may be used for cleaning, in particular together with hot water.

During a cleaning process the filter and/or the pump can be cleaned by means of additional cleaning substances or cleaning agents, potentially together with hot water. Such additional cleaning substances or agents can come from the dosing device described herein. During the hygiene program at least a part of the water guide system, including valves or the pump, can be cleaned by means of hot air, hot water, hot steam, or a combination of these options. As a step in the cleaning process and/or during the hygiene program, the filter can be backwashed to clean the filter. As another example, cleaning due to calcification or due to a valve not functioning properly can be initiated according to example embodiments.

The execution of a cleaning operation and/or of a hygiene program can be stored in the memory by the appliance control or is transmitted to the receiver by means of the communication module and a counter-communication module. This serves for the information about the performance of cleaning operations and/or of a hygiene program to be present also in the external receiver, preferably in connection with a possibly effected initiation which cannot be attributed to the user alone. This may be used accordingly in a calculation of costs to the user using the appliance in such a way that the fulfillment of aforementioned cleaning and service requirements may have a cost-reducing effect for the user. This may have taken place on the user's own initiative. The non-fulfillment of cleaning and/or service requirement may have a cost-increasing effect for the user due to the appliance having a worse technical state than necessary or usual. Cleaning can also be carried out during a phase of a washing program when no other action involving water movement in the appliance is taken. This may for example be when washing agents are interacting with the laundry in the drum, which usually takes some minutes. This time of regular inactivity of the appliance can be used for heating water for cleaning some of the parts mentioned before and for the cleaning itself. The overall time needed for the whole washing program will thus not be longer. The cleaning may also involve the use of cleaning agents mentioned before. If hot water is used additionally, the cleaning process may be more effective.

Furthermore, the general operating data and the individual operating data are used to perform predictive maintenance and/or fault detection of the domestic appliance. There may also be an adaptation to general operating data such as, in particular, water hardness of the fresh water provided into the appliance.

In certain embodiments, evaluating the individual operating data, in particular also with taking into account the general operating data, the appliance control can output information and/or instructions to a user to carry out or initiate certain cleaning steps and/or care steps on the domestic appliance. This shall help to improve the state of the appliance. The appliance control can recognize whether these steps have actually been carried out by the user and/or by the appliance. The memory can store whether these steps have been carried out and may transmit this information to the receiver via the communication module and the counter-communication module as described herein. For example, the appliance can provide instructions to the user to perform certain steps like decalcification.

It can be provided that in case a user does not perform the steps he has been requested to perform, such as in a predetermined timeframe such as one or two days, the appliance control initiates these steps itself or, by means of the communication module and the counter-communication module, initiates the performance by an external service technician who is called in. There is also an option to bill this to the user, not only because actual costs have been incurred, but also to provide better motivation to the user to perform recommended cleaning and maintenance in the future.

In a further embodiment, the appliance control may inform a user of a problem case by outputting corresponding information to the user and/or may directly initiate a call to a service technician by means of the communication module and the counter-communication module. This can help to keep the appliance in good condition. Information may be provided via a user interface of the appliance, and/or a user device communicatively connected to a network.

In certain embodiments, prior to performing a washing program or a cleaning operation and/or a hygiene program or the like, the above-mentioned valve to the chamber outlet is closed. Also, the above-mentioned valve with the valve outlet into the treatment chamber may be closed. This may help to exclude these areas from the cleaning operation and/or the hygiene program that is performed afterwards.

In certain embodiments, before a cleaning operation and/or before a hygiene program is carried out, the valves are set in such a way that a closed circuit for water is formed by the pump or which includes the pump, respectively. In certain embodiments, the filter may be included in such a circuit. In such a circuit, the pump can pump water and optionally a cleaning agent through the circuit for cleaning the pump itself, and possibly also any other components in the circuit, such as the filter. After cleaning, the circulating water can be pumped out of the appliance.

In certain embodiments, carrying out a cleaning operation and/or a hygiene program may include adjusting the valves to form a path or water line for water through the pump to the valve having a valve outlet into the treatment chamber. This valve can be arranged higher than the pump, so the pump will pump water and optionally a cleaning agent along this path up to the valve. When the water has reached the valve, it is then left to flow back again with the pump having been stopped. Such an oscillating movement of the water for the cleaning process can replace the circulating described above. This can be repeated for several times, for example ten to thirty times or continuously for a few minutes. After the cleaning operation, the water can be pumped out through the valve and its other valve outlet via the water outlet out of the domestic appliance.

At the end of a cleaning operation and/or a hygiene program described before, rinsing with fresh water is performed, in particular also the pump and/or the filter are rinsed. The fresh water can run along this path directly through to the water outlet of the domestic appliance.

In an example embodiment, values from a control for a drive of a movable treatment chamber are used for the individual operating data. These values of operating data may be selected from a current indicator, a voltage indicator, a temperature indicator, and/or a vibration indicator. This data may be acquired and stored in memory.

In certain embodiments, for the individual operating data values from a control of a heater for the water and/or the treatment chamber or information concerning consumption and/or composition of cleaning agent used are recorded and stored in the memory. These individual operating data values can include a duration and/or an energy consumption.

Furthermore, the domestic appliance can be connected to a solar thermal system in a house for supply with warm or hot water. For a cleaning process and/or for a hygiene program, the maximum temperature of this water coming from the solar thermal system can be used. Such warm or hot water may preferably also be used for a treatment or cleaning of objects therein.

The appliance can be connected to a photovoltaic system in a house for supply with electric power by said photovoltaic (PV) system. This may serve to adjust an electric heating of the appliance depending on the generated electric energy of the PV system for ecological reasons. For example, when there is plenty of electric energy of the PV system, it can be used for the energy consuming process of washing laundry, for example.

In certain embodiments, the appliance can be connected to a rainwater collection system, and/or a used-water collection system, for at least partial water supply. This water can be used at least for sections of a cleaning process and/or a hygiene program, such as after filtering or cleaning the water. It is possible to record in the individual operating data how long and/or how much rainwater is used. It can also be recorded which type of rainwater is used, in particular at least with regard to its water hardness which is usually less than hardness of drinking water.

It is also possible to integrate a weather forecast, including but not limited to a sunshine forecast and/or rain forecast. This allows for planning operation times for the appliance depending on the availability of cheap electricity, may be also of water if rainwater is collected and used, preferably after having been filtered or cleaned. Especially if rain or used water is used for any action in the appliance special attention is needed due to an increased risk of contamination or build-up of biofilms in the appliance. So the knowledge about such use is important to monitor the state of the appliance, in particular with regard to hygiene. In a further embodiment, data about the season and/or ambient temperature can be collected. This can be used to determine whether it is summer or winter, which can help to estimate whether light summer clothes from respective fabrics are to be expected, or whether heavy winter clothes from wool or the like can be expected or are actually treated in the appliance.

It is possible to update computer-executable instructions or to store or download additional computer-executable instructions into the memory of the appliance control via the communication module. It may furthermore be possible to enable or activate already existing functionalities in the appliance controller that have not yet been activated. For example, certain functionality implemented via computer-executable instructions can be installed in the memory, but not made immediately available to the user. According to certain embodiments, a user can pay per use for every use of such functionalities or pay a fixed fee for further use without regard to the number of uses. The functionalities can therefore be enabled via the communication module and thus be made available to the user. They can be made available for a one-time use or for permanent future use. It is furthermore possible to add such functionalities if they have not been pre-installed in the memory, for example corresponding to an upgrade or software update, respectively. Such an upgrade or software update can be made over the air and the Internet connection such that the user need not do anything with the technical aspect of such an upgrade or software update. In certain embodiments, not even a plug connection needs to be established with the over-the-air technology.

In certain embodiments, a receiver reproduces the appliance in the receiver in a digitized form, for example as a digital twin appliance data object. This can also be with all the error messages or fault messages of the actual appliance to have the reproduction or digital twin appliance data object that represents the real appliance. The digital twin appliance data object is described in further detail below.

These and further features are evident in the description and the drawings, the individual features each being implemented by themselves or in multiples in the form of sub combinations for an embodiment and in different fields and being able to be advantageous and independent protectable embodiments. The division of the application into individual sections and subheadings does not limit the general validity of the statements made thereunder. Many modifications and other embodiments of the disclosures set forth herein will come to mind to one skilled in the art to which these disclosures pertain having the benefit of the teachings presented in the descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

A water-bearing appliance is provided, including a treatment chamber for treating or cleaning objects therein by means of water, a water inlet into the appliance, and a water outlet out of the appliance, a water guide system in the appliance, connected to the water inlet and the water outlet, and a device for introducing water into the treatment chamber and a chamber outlet out of the treatment chamber. The water-bearing appliance further includes a pump, a filter, and valves in the water guide system, an appliance control connected to the valves and the pump, the appliance control having a memory and a communication module connected to communicate with a counter communication module external to the appliance, wherein the memory stores individual operating data acquired during an operation of the appliance, which individual operating data may comprise: a number of treatment operations, detergent consumption, type of a cleaning operation, maintenance program for the appliance, and the memory additionally stores general operating data for the appliance, wherein the general operating data may include: ambient temperature, water hardness and water temperature of the water let into the appliance.

In certain embodiments, a two-way valve is arranged in the water conduit just downstream of the water inlet into the appliance. In certain embodiments, a two-way valve is arranged in the chamber outlet. A valve may be arranged in the water conduit before the water outlet from the appliance, in particular in a conduit between the pump and the water outlet, said valve being a three-way valve and a first valve outlet leading to the water outlet and a second valve outlet leading to the insertion device into the treatment chamber.

In certain embodiments, behind the chamber outlet and behind a valve, the filter is arranged, wherein the filter comprises a filter inlet which is connected to the chamber outlet by means of the valve, the filter having a filter outlet which is connected to the pump by means of a further valve and a water conduit. A dosing device for cleaning agents is arranged in the water duct upstream of the pump, between the filter and the pump, the dosing device having a dosing outlet which is connected to a pump inlet. A further valve may be arranged downstream of a pump outlet of the pump, in particular a three-way valve, having a first valve outlet connected to the filter by means of a water line, wherein a second valve outlet is connected to the water outlet from the appliance by means of a water line.

The water conduit with the pump and the filter and several valves, with all valves except one valve at the water inlet into the appliance, is arranged in an independently manageable assembly unit which is arranged below the treatment chamber and which is designed to be movable as an assembly unit in such a way that it can be at least partially pulled out of the appliance, wherein the assembly unit has no rigid water-carrying connection to the treatment chamber.

The lines going from the assembly unit to the outside and the lines coming from the outside to the assembly unit are at least partially variable in length, are designed as at least one of flexible or elastic telescopic hoses, wherein the lines are not fixedly installed at connections or free ends, are flexible and variable in location, wherein the connections are manually releasable water couplings.

According to certain embodiments, the chamber outlet and the valve are arranged between the chamber outlet and the filter, a pre-filter is arranged in the water conduit, wherein the pre-filter is manually cleanable and being arranged in an assembly unit, so that the pre-filter is accessible from above, for manual cleaning when the assembly unit is pulled out of the appliance.

The communication module is designed for wireless communication, in particular by means of a method from the group: WLAN, Bluetooth, ZigBee.

A method for operating a water-carrying appliance is provided, wherein the general operating data, which apply to the appliance at an installation location, are determined during or after the initial start-up and are stored in the memory of the appliance control or in a receiver connected to the counter-communication module, the general operating data being obtained via at least one of a sensor or via a network, and wherein the individual operating data are stored in the memory of the appliance control during operation of the appliance, the appliance control transmits the general operating data and the individual operating data to a receiver via the communication module by means of a counter-communication module, the operating data being stored in the receiver in such a way that they are assigned to this specific appliance.

The appliance control unit carries out at least one of a cleaning process or a hygiene program for the appliance on its own, determined on the basis of the general operating data and the individual operating data, or triggered by an instigation from outside, the instigation having been received by means of the communication module, wherein during the cleaning process by means of additional cleaning substances, from a dosing device, at least one of the water conduction, the filter, or the pump, are cleaned, wherein in particular during the hygiene program by means of at least one of hot air, hot water, hot steam at least the pump of the water guide system, is cleaned, wherein during the at least one of the cleaning process or the hygiene program the filter is backwashed.

The execution of the at least one of the cleaning process or the hygiene program is stored in the memory or is transmitted to the receiver by means of the communication module and a counter-communication module. In certain embodiments, a cleaning process of one or more parts, such as a water line, the pump, or the valves is performed during a phase of a washing program in which no other action involving water movement in the appliance is taken because washing agents are interacting with laundry in a treatment chamber.

A dosing device may be monitored for consumption of cleaning agents, washing agents, disinfectants or the like being stored therein, wherein data generated therefrom is at least one of stored in the memory of the appliance control or transmitted to the receiver and stored therein.

The performance of the at least one of the cleaning process or the hygiene program is stored in the receiver in connection with an initiation which is not attributable to a user alone, this being used accordingly in a calculation of costs to a user, wherein a fulfilment of cleaning and service requirements has a cost-reducing effect for the user, and wherein a non-fulfilment of the cleaning and the service requirements has a cost-increasing effect for the user, an indicator of which is stored in the receiver.

According to certain embodiments, the general operating data and the individual operating data are used to perform at least one of predictive maintenance or fault detection of the appliance and adaptation to general operating data.

Evaluating the individual operating data, in particular also taking into account the general operating data, the appliance control outputs at least one of information or instructions via a user interface indicating at least one of a cleaning step or a care step on the appliance, the appliance control recognizing whether the at least one of the cleaning step or the care step have actually been carried out by the user, and transmitting an indication of whether the at least one of the cleaning step or the care step have actually been carried out by the user to the receiver via the communication module and the counter-communication module.

In an instance case a user does not perform the at least one of the cleaning step or the care step, the appliance control automatically initiates the at least one of the cleaning step or the care step, by means of the communication module and the counter-communication module, or initiates communication of the at least one of the cleaning step or the care step to an external service technician.

In certain embodiments, the appliance control informs a user of a problem case by outputting corresponding information or directly initiates the calling of a service technician by means of the communication module and the counter-communication module. The method may further comprise wherein prior to performing the at least one of the cleaning process or the hygiene program, a valve to a chamber outlet is closed, and the valve with the valve outlet into a treatment chamber is closed, in order to exclude these areas from the cleaning operation and/or the hygiene program.

In certain embodiments, before the at least one of the cleaning process or the hygiene program is carried out, the valves are set in such a way that a closed circuit for water is formed by the pump and the filter, wherein the pump pumps water through the circuit.

In certain embodiments, for carrying out the at least one of the cleaning operation or the hygiene program, the valves are adjusted to form a path for water through the pump to the valve with the valve outlet into a treatment chamber, which valve is arranged higher than the pump, whereby the pump pumps water along this path up to the valve and then leaving the water back again with the pump stopped, this process being repeated and, at the end the water being pumped out of the appliance through the valve and its other valve outlet to the water outlet.

In certain embodiments, at the end of a cleaning operation and/or a hygiene program, rinsing is performed with fresh water, and at least one of the pump or the filter, with the fresh water running directly through to the water outlet from the appliance.

In certain embodiments, for the individual operating data values from a control for a drive of a movable treatment chamber are used, selected from the group of a current indicator, a voltage indicator, a temperature indicator, a vibration indicator. In certain embodiments, the individual operating data values are from at least one of a control of a heater for at least one of the water or the treatment chamber, a duration, an energy consumption, or information concerning at least one of consumption or composition of cleaning agent used are recorded and stored in the memory.

In certain embodiments, the appliance is connected to a solar thermal system for water supply, wherein for at least one of the cleaning process or the hygiene program a maximum temperature of the water of the solar thermal system is used. In certain embodiments, the appliance is connected to a photovoltaic system for power supply by said photovoltaic system, wherein an electric heating of the appliance is adjusted depending on the generated electric energy of the photovoltaic system. In certain embodiments, the appliance is connected to a rainwater collection system for at least partial water supply, at least for sections of the at least one of the cleaning process or the hygiene program, wherein it is recorded in the individual operating data how long and how much rainwater is used, and a water hardness thereof.

In certain embodiments, additional computer-executable instructions stored in the memory of the appliance control via the communication module are enabled or activated. The appliance may be reproduced in the receiver in a digitized form, with error messages or fault messages.

The memory contains functionalities for the appliance that are not available to a user at the beginning, but only become available after further payment to a user and owner of the appliance, the functionalities then being enabled via the communication module and thus being made available to the user.

A method is provided for generating a maintenance data object for an appliance, the method comprising receiving, by one or more processors, operating data for the appliance, wherein the operating data for the appliance is automatically collected by the appliance, and is associated with at least one of a water inlet, a temperature sensor, or a dosing device of the appliance. The method further includes generating, by the one or more processors, a digital twin appliance data object based at least in part on the operating data and manufacturer data associated with the appliance. The method includes generating, by the one or more processors and using one or more machine learning models, a predictive maintenance data object, wherein (a) the one or more machine learning models have been trained with training operating data from a plurality of appliances, and (b) the predictive maintenance data object describes a predicted outcome of the appliance based at least in part on the operating data.

The training operating data may include or is associated with at least one outcome comprising at least one of a repair, a damage indicator, an error, or an life expectancy, wherein the one or more machine learning models are trained to predict outcomes according to patterns in the training operating data that impact the respective outcomes, and wherein the predictive maintenance data object is generated to mitigate the predicted outcome of the appliance or increase a life expectancy of the appliance.

The method may further include causing transmission of the predictive maintenance data object toward the appliance, wherein in response thereto, at least one maintenance task is at least one of automatically initiated by the appliance or communicated via a user interface.

The method may further include receiving, via the network, the training operating data from the plurality of appliances, generating the one or more machine learning models by correlating respective training operating data with respective manufacturer data, and at least one outcome comprising at least one of a cleaning indicator, a repair indicator, a damage indicator, an error, or a life expectancy, and training the one or more machine learning models to learn patterns in the training operating data that impact the respective outcomes.

In certain embodiments, the predictive maintenance data object may include at least one of a cleaning schedule or maintenance program. In certain embodiments, the operating data is received from the appliance according to a predetermined schedule. In certain embodiments, the operating data is received from the appliance in response to detection of at least one predefined condition being satisfied. The subject operating data comprises at least one of a number of treatment operations, a rate of treatment operations, a detergent consumption indicator, a type of a cleaning operation, an ambient temperature, a water hardness indicator, or a water temperature.

A method is provided for generating a maintenance data object for an appliance, the method including receiving operating data for the appliance, wherein the operating data for the appliance is automatically collected by the appliance, and is associated with at least one of a water inlet, a temperature sensor, or a dosing device of the appliance. The method further includes generating a digital twin appliance data object based at least in part on the operating data and manufacturer data associated with the appliance, and generating, using one or more machine learning models, a predictive maintenance data object, wherein (a) the one or more machine learning models have been trained with training operating data from a plurality of appliances, and (b) the predictive maintenance data object describes a predicted outcome of the appliance based at least in part on the operating data.

The method further includes causing transmission of the predictive maintenance data object toward the appliance, wherein in response thereto, at least one maintenance task is at least one of automatically initiated by the appliance or communicated via a user interface. The method further includes receiving, via the network, the training operating data from the plurality of appliances, generating the one or more machine learning models by correlating respective training operating data with respective manufacturer data, and at least one outcome comprising at least one of a cleaning indicator, a repair indicator, a damage indicator, an error, or a life expectancy, and training the one or more machine learning models to learn patterns in the training operating data that impact the respective outcomes.

An apparatus is provided for generating a maintenance data object for an appliance, the apparatus comprising at least one processor and at least one memory including computer program code, the at least one memory and the computer program code configured to, with the processor, cause the apparatus to at least: receive operating data for the appliance, wherein the operating data for the appliance is automatically collected by the appliance, and is associated with at least one of a water inlet, a temperature sensor, or a dosing device of the appliance, generate a digital twin appliance data object based at least in part on the operating data and manufacturer data associated with the appliance, and generate using one or more machine learning models, a predictive maintenance data object, wherein (a) the one or more machine learning models have been trained with training operating data from a plurality of appliances, and (b) the predictive maintenance data object describes a predicted outcome of the appliance based at least in part on the operating data.

The at least one memory and the computer program code are further configured to cause the apparatus to at least cause transmission of the predictive maintenance data object toward the appliance, wherein in response thereto, at least one maintenance task is at least one of automatically initiated by the appliance or communicated via a user interface. The at least one memory and the computer program code are further configured to cause the apparatus to at least receive, via the network, the training operating data from the plurality of appliances, generate the one or more machine learning models by correlating respective training operating data with respective manufacturer data, and at least one outcome comprising at least one of a cleaning indicator, a repair indicator, a damage indicator, an error, or a life expectancy, and train the one or more machine learning models to learn patterns in the training operating data that impact the respective outcomes.

An apparatus for generating a maintenance data object for an appliance is provided, the apparatus comprising means for receiving operating data for the appliance, wherein the operating data for the appliance is automatically collected by the appliance, and is associated with at least one of a water inlet, a temperature sensor, or a dosing device of the appliance. The apparatus further includes means for generating a digital twin appliance data object based at least in part on the operating data and manufacturer data associated with the appliance, and means for generating, using one or more machine learning models, a predictive maintenance data object, wherein (a) the one or more machine learning models have been trained with training operating data from a plurality of appliances, and (b) the predictive maintenance data object describes a predicted outcome of the appliance based at least in part on the operating data.

The apparatus may further include means for causing transmission of the predictive maintenance data object toward the appliance, wherein in response thereto, at least one maintenance task is at least one of automatically initiated by the appliance or communicated via a user interface. The apparatus further includes means for receiving, via the network, the training operating data from the plurality of appliances, means for generating the one or more machine learning models by correlating respective training operating data with respective manufacturer data, and at least one outcome comprising at least one of a cleaning indicator, a repair indicator, a damage indicator, an error, or a life expectancy, and means for training the one or more machine learning models to learn patterns in the training operating data that impact the respective outcomes.

A computer program product is provided, including at least one non-transitory computer-readable storage medium having computer-executable program code instructions stored therein, the computer-executable program code instructions comprising program code instructions to receive operating data for the appliance, wherein the operating data for the appliance is automatically collected by the appliance, and is associated with at least one of a water inlet, a temperature sensor, or a dosing device of the appliance, generate a digital twin appliance data object based at least in part on the operating data and manufacturer data associated with the appliance, and generate, using one or more machine learning models, a predictive maintenance data object, wherein (a) the one or more machine learning models have been trained with training operating data from a plurality of appliances, and (b) the predictive maintenance data object describes a predicted outcome of the appliance based at least in part on the operating data.

The computer-executable program code instructions further comprise program code instructions to cause transmission of the predictive maintenance data object toward the appliance, wherein in response thereto, at least one maintenance task is at least one of automatically initiated by the appliance or communicated via a user interface. The computer-executable program code instructions further comprise program code instructions to receive, via the network, the training operating data from the plurality of appliances, generate the one or more machine learning models by correlating respective training operating data with respective manufacturer data, and at least one outcome comprising at least one of a cleaning indicator, a repair indicator, a damage indicator, an error, or a life expectancy, and train the one or more machine learning models to learn patterns in the training operating data that impact the respective outcomes.

BRIEF DESCRIPTION OF THE DRAWINGS

Figure 1:
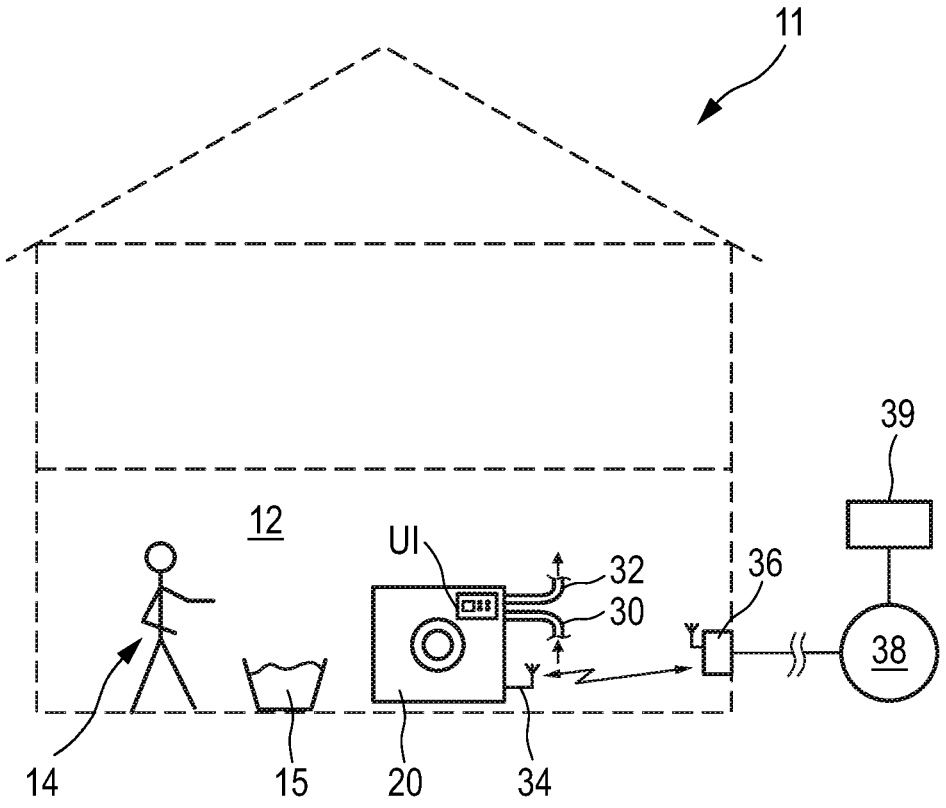
Figure 2:
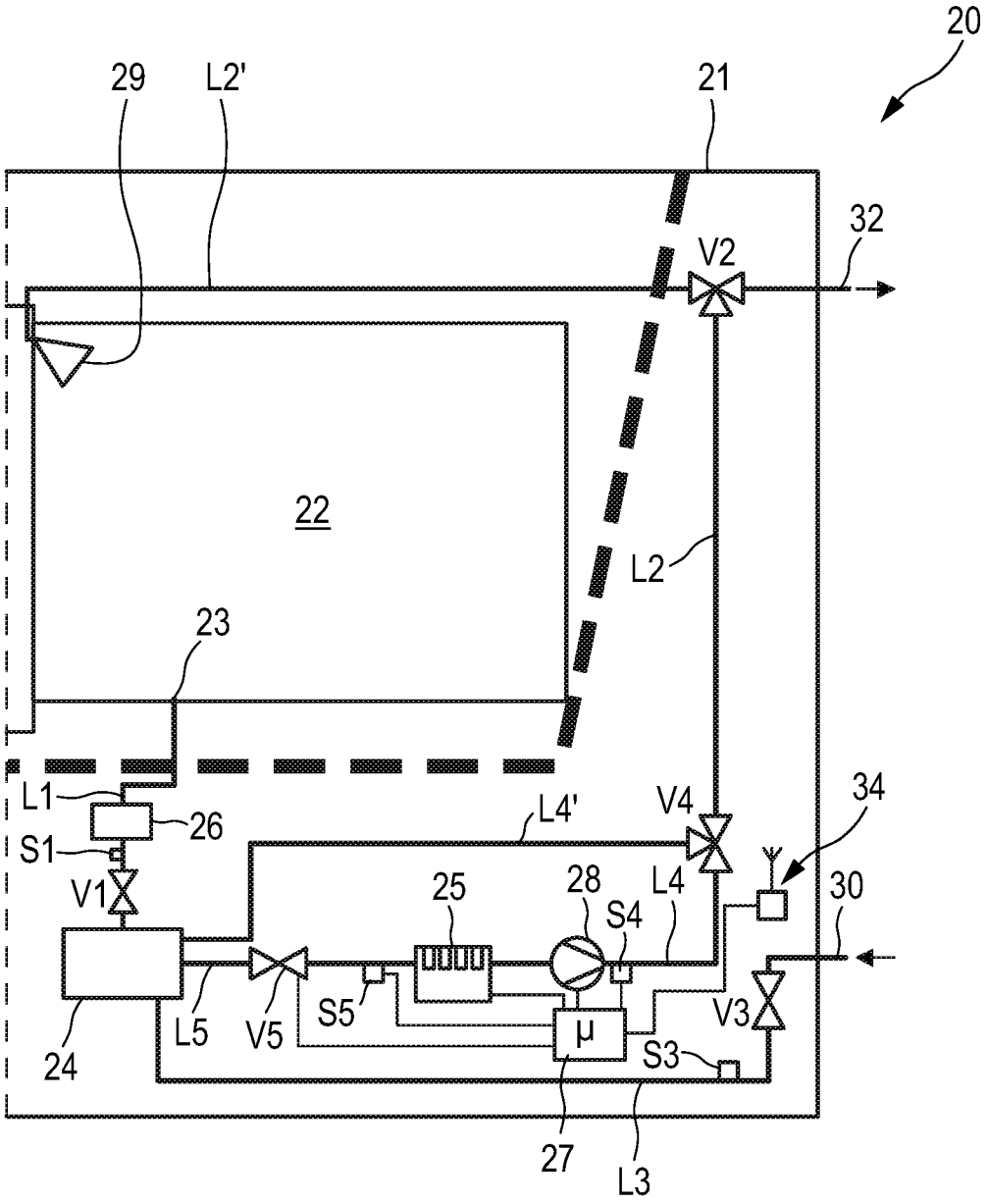
Figure 3:
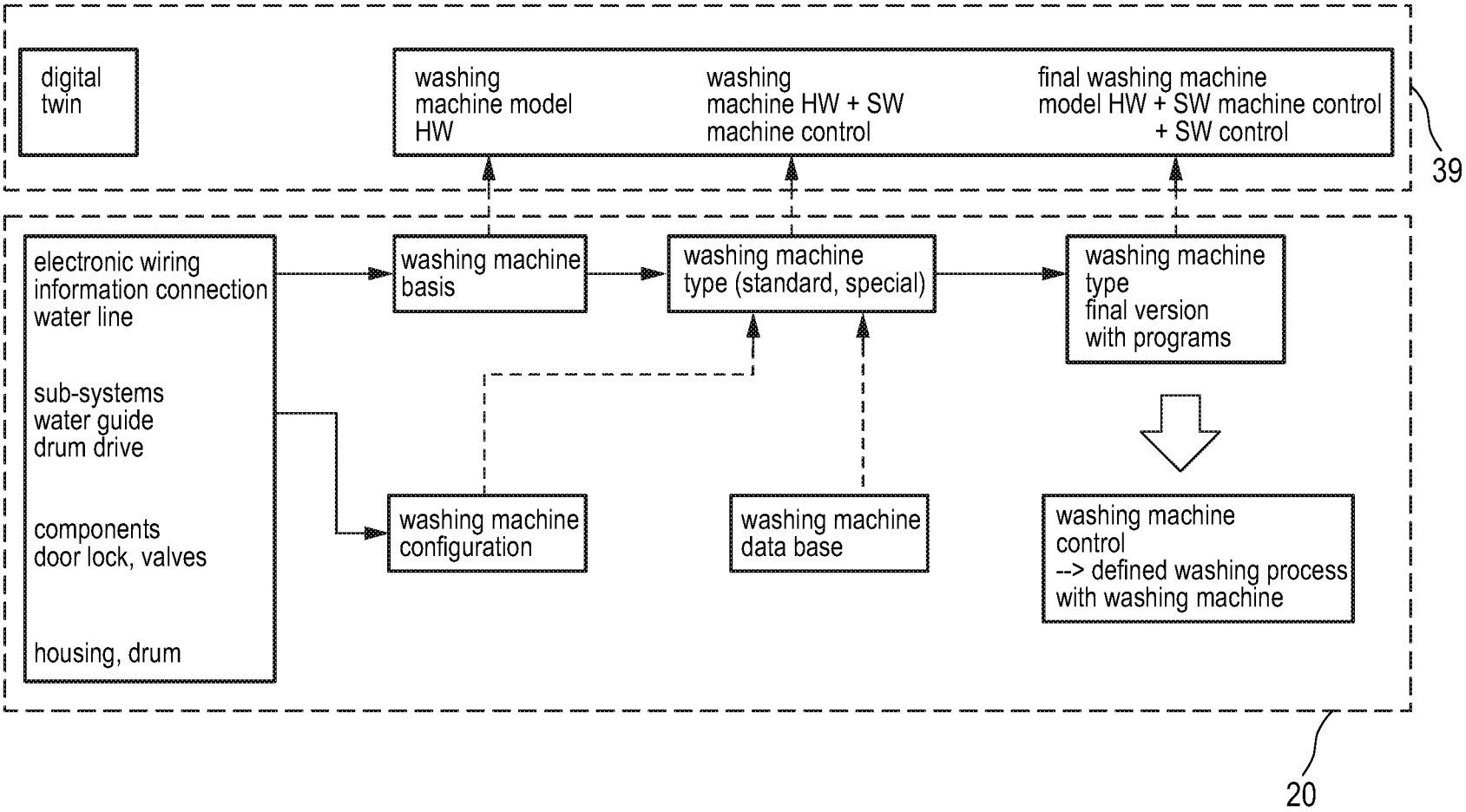
Figure 4:
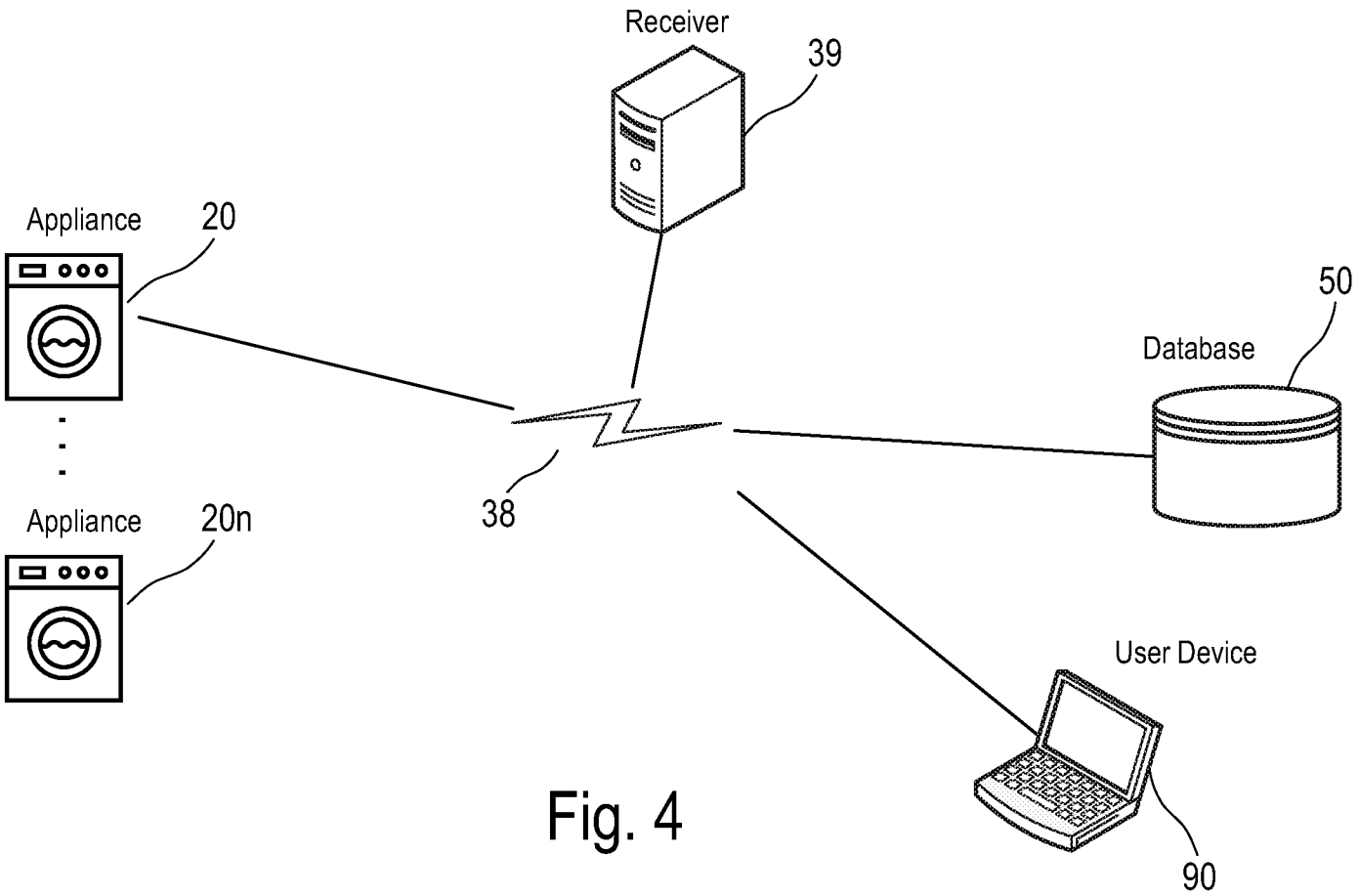
Figure 5:
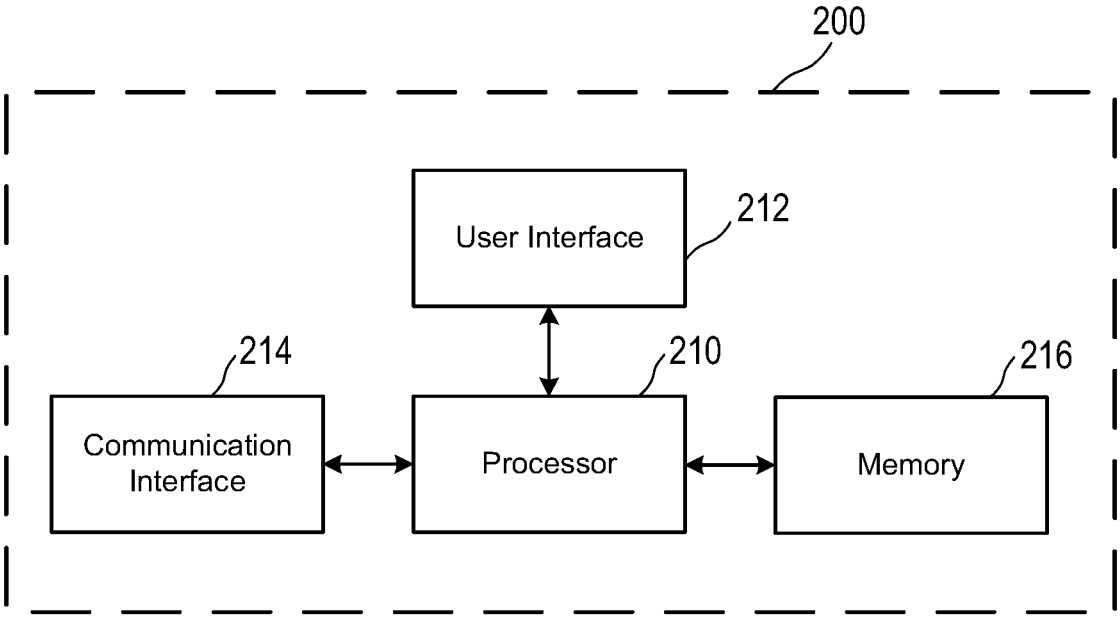
Figure 6:
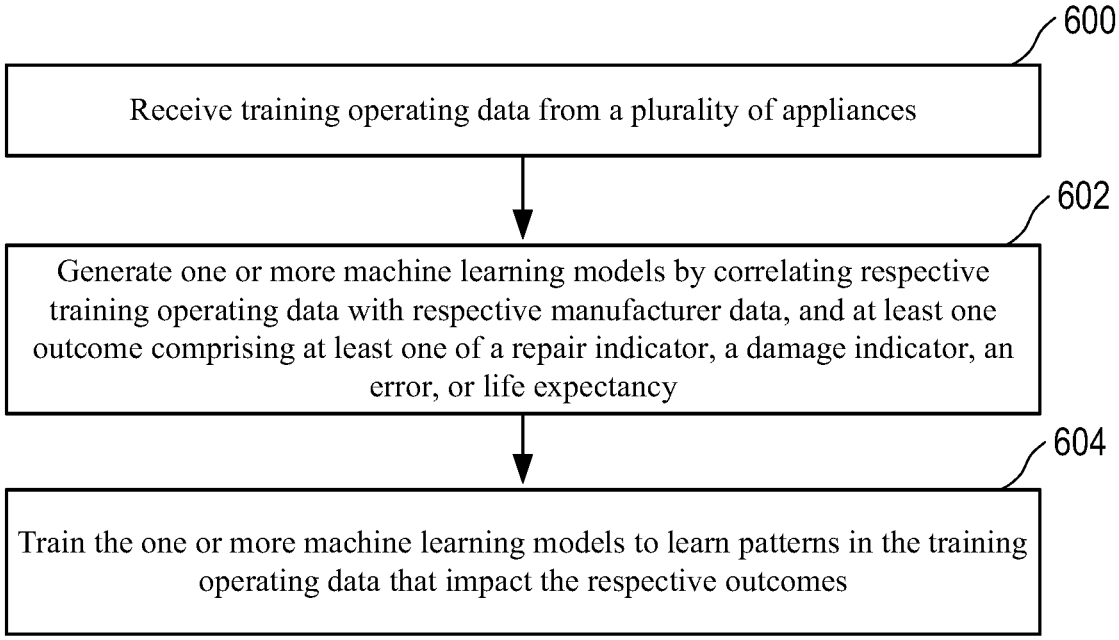
Figure 7:
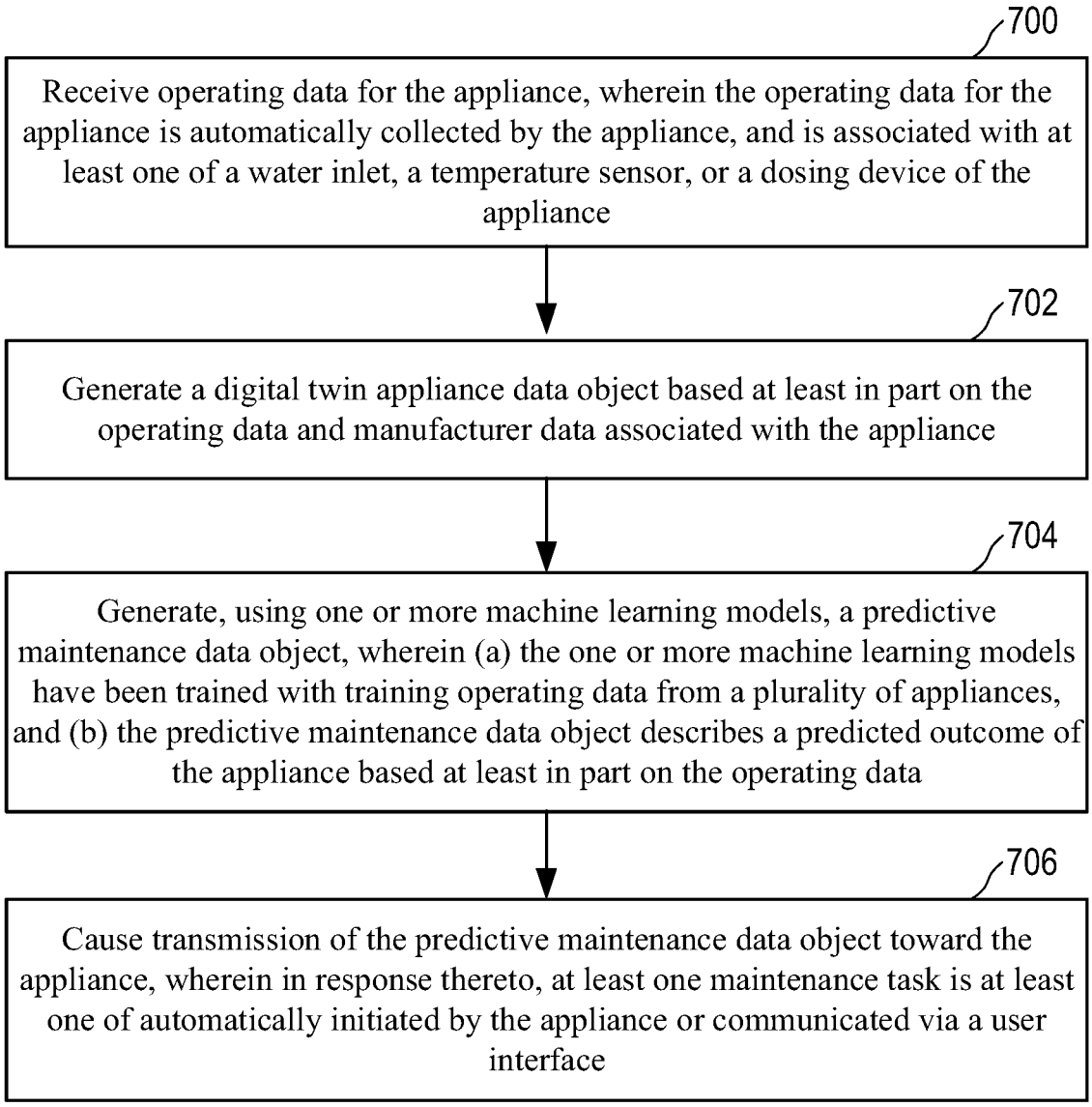

Having thus described certain example embodiments of the present invention in general terms, reference will hereinafter be made to the accompanying drawings which are not necessarily drawn to scale, and wherein:

FIG. 1 is a schematic view of a washing machine in a house being connected to a receiver via a network, according to certain embodiments;

FIG. 2 is a schematic view of functional parts of a washing machine with functional parts grouped in a drawer assembly, according to certain embodiments; and FIG. 3 is a schematic view of a digital twin appliance data object associated with an appliance;

FIG. 4 is an overview of a system that can be used to practice certain embodiments described herein;

FIG. 5 is a schematic diagram of an apparatus according to certain embodiments; and FIGS. 6 and 7 are flowcharts illustrating operations performed in accordance with some example embodiments.

DETAILED DESCRIPTION OF THE EMBODIMENTS

Various embodiments now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. Like numbers refer to like elements throughout.

In FIG. 1 a configuration as is known in the art is shown with a house 11 shown in dashed lines having a basement room 12. In the basement room 12, a user 14 is about to wash laundry 15 in an appliance 20 being installed in the basement room 12. The appliance 20 has an electrical connection not shown here, a water inlet 30 and a water outlet 32. It also has a user interface UI on the front side with operating elements, a display and/or the like. Additionally, or alternatively, appliance 20 has a Wi-Fi module 34. This Wi-Fi module 34 is connected in wireless manner to a Wi-Fi access point 36 placed somewhere in the house 11 for a communication connection between the two. The Wi-Fi access point 36 again is, as is known in the art, connected to network 38, such as the Internet, preferably via a conventional cable.

A receiver 39 is shown which is also connected to the network 38. This receiver may be a server, distributed system, and/or other like computing device or system, and can be placed somewhere around the world, for example with a company owning the appliance 20 and lending or leasing the appliance 20 to the user 14. The receiver 39 collects data generated and sent by the appliance 20 to form a digital twin appliance data object based on the data, as described in further detail herein.

FIG. 2 shows details of the construction of the appliance 20 having a housing 21 and a treatment chamber 22 provided therein. Water inlet 30 is provided with a valve V3 directly at the housing 21 to be able to close any water supply into the appliance 20. A water line l3 runs from valve V3 to a filter 24 for filtering the fresh water supplied into the appliance 20. One of the filter outlets of filter 24 leads via a further line l5 with a valve V5 therein to a dosing device 25. This dosing device contains substances needed for the washing process such as detergent, decalcifier, softener and the like. In an example embodiment, the dosing device 25 is adapted to act independently and automatically of any action of user 14. In consequence, user 14 need not fill or add any such substances, but only choose parameters such as amount of laundry, kind of laundry or fiber, preferred washing program and/or the like on a user interface UI on the appliance 20. Dosing device 25 will then automatically add the right substance in the right amount at the right time. This can be controlled not only by the dosing device 25 itself, but also by an appliance controller 27 being connected to it. In certain embodiments, detergents are combined in a dosing device that is prefilled in a defined way with known detergent. The dosing device may be replaced by a user as a whole, or a user may replace a cartridge in and out of the dosing device. The cartridge and/or dosing device may be coded or provided with a chip for identification. The code may be read in the washing machine, and the information from this code, including what types of detergents are used, detergent composition, ingredients, frequency, quantity and/or the like, can be sent to the receiver to be used together with the digital twin. The appliance controller 27 is also connected with other functional units of the appliance 20.

In the appliance controller 27, alternatively in the receiver 39, the so-called 'Sinner's circle' can be stored, which is known to describe the four factors temperature, time, chemistry and mechanical action. These four factors determine the result of a cleaning or washing action. Knowledge about and use of these four factors allows for optimizing the cleaning or washing action in the appliance. These four factors can be measured in the appliance and are available as such.

The dosing device 25 is connected via a further short water line to a pump 28. Such a pump has a pump drive, which is not shown here, and may be an impeller pump, for example according to U.S. Patent Publication No. 2013/022455A1 which is hereby incorporated by reference in its entirety. The pump 28 preferably comprises an integrated heating element such that water can be pumped or transported, respectively, as well as heated in the same process or step. This allows for a high integration of functions as well as an efficient heating of water.

A further water line l4 leads from an outlet of the pump 28 to a further valve V4 which is a three-way valve. One valve outlet leads via a water line l4' to the filter 24 for backwashing the filter. Another water line l2 leads from the other valve outlet of valve V4 to a further three-way valve V2. One outlet of the valve V2 is the water outlet 32 leading out of the appliance 20. The other outlet leads via a further water line l2' to a spraying nozzle 29 which serves to bring water into the treatment chamber 22 for the washing process. Such spraying nozzles 29 or insertion devices are also known in the art.

The valve V4, may be optional in certain embodiments, and may be referred to as an auxiliary valve. The valve V4 may further enable a self-cleaning cycle to be performed, such as but not limited to rinsing filters, and/or activation of special injection nozzles, which remove deposits at known critical points. The self-cleaning function could also be activated by a function for enabling the insert. Computer-executable instructions may be installed on memory to enable the self-cleaning function and may be configured to execute the self-cleaning on a routine schedule, and/or as directed by a received predictive maintenance data object, as described in further detail herein.

In certain embodiments, the chemistry for self-cleaning could already be available in the washing machine, but, if necessary, the activation triggers not only the technical functionality of self-cleaning, but also the ordering of appropriate cleaning agents, which are then suitably introduced into the washing machine. The cleaning agents and/or suitable chemistry, may be provided in the dosing device 25 described herein.

In certain embodiments, some, or all functionality of the self-cleaning could be integrated on the inverter board, collecting the operating data (e.g., temperature, current-voltage curves, laundry type, program selection) on the inverter. In certain embodiments, at least the inverter provides a part of this data. The inverter (for power control of the drive motor of the drum) as virtual sensor for recognition of operating conditions and processes from current-voltage curves. Control of electromechanical components can occur via the inverter or a dedicated control board. It will be appreciated that in certain embodiments, auxiliary valve (V4) could also be installed as a replacement component in the system drawer that includes hydraulic elements.

Accordingly, self-cleaning could be triggered by direct measured values or by evaluating accumulated operating parameters. For example, if washing is done at 30° C. for a longer period of time, this will eventually trigger a hot program that disinfects the washing machine. As another example, after a certain number of wash cycles the filter cleaning is activated via backwash and/or a self-cleaning cycle. In certain embodiments, conditions such as those mentioned above may be adjusted and/or dynamically calculated using one or more machine learning models, described in further detail below, to calculate the condition (such as a temperature, and how many cycles) at which a self-cleaning cycle is performed. Performing self-cleaning according to a machine learning model may aim to optimize or improve the use of the self-cleaning cycle without over-performing the self-cleaning cycle and otherwise wasting power, water and/or any applicable cleaning solutions. The cleaning programs may be intelligently and dynamically created for an appliance based on its associated operating conditions, rather than being predefined. The cleaning programs can include a multitude of variable conditions such as but not limited to different chemistries of cleaning solutions, temperatures, time, and volume flow (thus mechanics) to determine optimal cleaning.

In certain embodiments, an inverter may provide physical inverter data acquired by the washing machine or sensors, including but not limited to a current/voltage line indicator, a temperature indicator, and/or a vibration indicator. Vibration may provide an indication if the washing machine is being overloaded or loaded with heavy items. In certain embodiments, further data may be derived from operating data, including but not limited to torque, weight, and/or energy input/output.

Any unbalance from the load in the drum resulting in such vibration can be measured, for example from data of the drive motor of the drum such as motor torque or motor current. This can be monitored during operation of the appliance to build a history of operation with an unbalanced drum to know the actual and accumulated strain on the bearings of the drum. It is possible to store this data in the appliance controller 27, but mainly in the receiver 39 for adapting the digital twin to it. This helps to have the digital twin to be as complete as possible, which again allows for better assessing whether the washing machine needs servicing on site or whether it needs major maintenance or repair when returned from the user.

A chamber outlet 23 is provided at the bottom of the treatment chamber 22 leading with a short water line l1 to a pre-filter 26. This pre-filter 26 is adapted to filter larger objects out of the water, such as socks, coins, small stones, or the like. The pre-filter 26 is also provided in the water line l1 to a further valve V1 to protect said valve V1. The valve V1 serves to control the water outlet out of the treatment chamber 22. Another short water line leads from valve V1 to a filter inlet of the filter 24 as described before.

An alternative to providing such an automatic dosing device 25 as shown in FIG. 2 can be a conventional dosing device, which for example can be provided in an upper corner region of a front side of the appliance 20.

A number of sensors can be provided in the appliance 20 as explained herein. Some of these may be temperature sensors. One such temperature sensor S1 can be provided at or close to the chamber outlet 23, for example in the water line l1 shortly before the valve V1. This temperature sensor S1 serves to measure the temperature of water exiting from the treatment chamber 22.

Another temperature sensor S3 may be provided in the water line l3 shortly behind the valve V3. This temperature sensor serves to detect the temperature of fresh water entering the appliance 20 via the water inlet 30 with the valve V3. The valve V3 and consequently letting water in is controlled by the appliance controller 27.

Additionally or alternatively, a temperature sensor S5 is provided shortly before the dosing device 25 in the water line l5. This temperature sensor S5 serves to detect the temperature of water before it is pumped and possibly also heated by the pump 28, potentially also to improve a dosing of substances depending on the water temperature. Together with another temperature sensor S4 provided in the water line l4 directly after the pump 28 a temperature difference in the water directly before and after the pump 28 can be measured, which serves to sense information about a heating efficiency, heating effect, calcification of the pump 28 and the like. The temperature sensors S1, S3, S4 and/or S5 are connected to the appliance controller 27 to gather their temperature data. This temperature data is used for controlling the washing process. In certain embodiments, this temperature data may be further processed and then transferred via the Wi-Fi module 34 and the Wi-Fi access point 36 to the receiver 39 as described in connection with FIG. 1. According to certain embodiments, the data of a pump motor and of a heating element of the pump 28 can be gathered and transferred to the receiver 39. Furthermore, the appliance controller 27 may not only serve to control or influence operation of the dosing device 25 but can also gather and transfer respective data concerning consumption and stock of washing substances, agents, and the like in the dosing device 25.

During normal operation of the appliance 20, freshwater streams into the appliance 20 via the valve V3 and the water line l3. The water temperature is measured by the temperature sensor S3. The fresh water is filtered via the filter 24 and may, through the open valve V5 and the water line l5, be pumped by the pump 28 and water lines 14 and 12 as well as the valves V4 and V2 to the spraying nozzle 29. The water can then be sprayed onto laundry in the treatment chamber 22. It is provided that via any kind of sensor or via the operation of the pump 28, the appliance controller 27 has the information about the amount of fresh water let into the appliance 20. When a sufficient amount of water is inside the appliance 20 as has been pre-specified by a washing program chosen by the user 14, the appliance controller 27 will shut the valve V3. For thorough wetting of the laundry in the treatment chamber 22, the valve V1 is opened, and water will flow through the water line l1 and the valve V1 to the filter 24. The filtered water will leave the filter 24 via the filter outlet to water line l5 and through the open valve V5 to the pump 28. This water may then be pumped in circulating manner until the laundry is sufficiently wetted.

In a next step, detergents or any other washing substances may be dosed into the water by dosing device 25. As the pump 28 is provided shortly behind or after the dosing device 25, the water and the substances may be mixed in efficient manner and then again be brought onto the laundry via the spraying nozzle 29. In certain embodiments, this may be performed several times in cycling manner.

For removing water from the appliance 20, the valve V2 is operated such that the valve outlet to the water outlet 32 is opened. Then the pump 28 can pump this water out of the appliance 20.

If the valve V1 is closed, valve V5 is opened and valve V4 is opened with its valve outlet to the water line l4', water again can be circulated through the filter 24 and the pump 28.

For cleaning the pump 28, fresh water from water inlet 30 may be used and, again, pumped directly out of the appliance 20 at water outlet 32.

In another option, the filter inlet from water line l3 into the filter 24 can be adapted for backwashing the filter 24. In this case, fresh water let into the appliance 20 at the water inlet 30 enters the filter 24 for backwashing. The filtrate of filter 24 can be removed from the pressure of the freshwater inlet 30 through the water line l4' to the valve V4, which is directing the flow of water such that it flows through the water line l2 to the valve V2. Valve V5 is closed. From valve V2, water flows through the respective valve outlet to the water outlet 32. In this case, only the pressure of the fresh water entering at water inlet 30 can be used for backwashing the filter 24. On the other hand, this backwashing is possible without the use of the pump 28 and without the filtrate that has been backwashed out of the filter 24 going through any functional unit except the water lines l4', l2 and 32 and the valves V4 and V2. In an alternative embodiment, a further water line with a valve can be provided behind the pump 28 which leads to a filter inlet for such a backwashing.

In an example embodiment, the appliance 20 is provided with an assembly unit in a drawer or drawer-like assembly. This drawer-like assembly unit can be functionally divided by the thick line going beneath the treatment chamber 22 and left of the valve V2. This means that the functional units beneath and to the right of the thick line may be provided in the assembly unit. The connection to the water line l2' and the water line l1 to the chamber outlet 23 is then provided via flexible hoses that allow the assembly unit to be drawn out of the washing machine without the need to separate lines, which would also be possible via water line couplings or the like. In a similar manner, the water lines between the valve V2 and the water outlet 32 as well as between the valve V3 and the water inlet 30 can be either flexible hoses or can be provided with water line couplings or the like for direct removal. Further details as to how such a removable assembly unit may be constructed, is described in DE 10 2021 204 201 A1.

Another sensor may be provided at the filter 24 and the pre-filter 26 to detect their degree of pollution or use, respectively, and/or whether they have been cleaned sufficiently in a manner provided for. If the pre-filter 26 can only be manually cleaned, interaction with the user 14 is needed for this. Any indication to the user 14 may be given by signal lamps or a display on the front side at the user interface UI according to FIG. 1. This may either be initiated by such a sensor directly provided on the pre-filter 26. Alternatively, it can be decided in the receiver 39, preferably via the respective digital twin appliance data object, that such a manual cleaning of the pre-filter 26 may be needed or should be performed as regular action.

A cleaning process of the filter 24, such as backwashing described herein, can also be initiated by the receiver 39. Alternatively, a signal can be given to the user 14 on the user interface UI to initiate such a cleaning process of the filter 24. The appliance controller 27 can then monitor whether this cleaning process has been performed in correct manner by the user 14.

Further automatic functions that can be initiated by the receiver 39 are cleaning at least a major part of the water guide system with the water lines and the valves with hot water that has been heated respectively by the pump 28 and its integrated heating element. This can include the water lines l4, l2 and l2' as well as the valves V4 and V2 and the spraying nozzle 29. Depending on the construction of the filter 24, a further water circulating can be provided through water line l4, valve V4, water line l4', the filter 24, water line l5 and valve V5. Further options include the use of a cleaning agent or the like that can be stored in the dosing device 25 and used when needed. One example for a trigger for this cleaning type may be according to the machine learning model described in further detail below. Such a cleaning may be carried out in non-use hours or optimal energy use hours, or when sufficient and/or optimal electric energy is available from a PV system on a roof of the house.

Further information that may be gathered by the appliance controller 27 or by any sensors include a water hardness of water being supplied to the water inlet 30, and/or a water pressure present at the water inlet 30. Cleaning can also be carried out during a phase of a washing program when no other action involving water movement in the appliance 20 is taken. This may for example be when washing agents are interacting with the laundry in the treatment chamber 22, which usually takes some time, such as a few minutes. This time of regular inactivity of the appliance 20 can be used for heating water for cleaning some of the parts mentioned before and for the cleaning itself. The overall time needed for the whole washing program will thus not be longer. The cleaning may also involve the use of cleaning agents mentioned herein. If hot water is used additionally, the cleaning process may be more effective.

In FIG. 3 a division between the appliance 20 as physical unit and the receiver 39 is shown. Their connection is via the Wi-Fi connection according to FIG. 1. The digital twin appliance data object in the receiver 39 is made up of the information about the washing machine regarding the specific washing machine type with its individual specifications, mechanical specifications, and programs. The configuration of the washing machine as well as the data collected therein, in particular by the sensors S, depend on the washing machine type and thus influence the data in the digital twin appliance data object. The state of the washing machine and its configuration and programming do again have an impact on the actual washing process being run in the washing machine.

As indicated in FIG. 3, the receiver 39 forms a digital twin appliance data object representative of the appliance 20 with the data that can be gathered in the appliance 20, either by sensors S and/or in other ways known to the appliance controller 27. This allows, for example, for the appliance 20 to be provided to the user 14 by a service company that does not sell the appliance 20 for a one-time payment sum, but has established a leasing agreement where the washing machine is provided to the user 14 for only a small fee or for no fee at the beginning. The user will then have an agreement with so-called pay-per-unit or, respectively, where he only pays to the service company owning the washing machine for exactly as much as he uses the washing machine. This can, for example, also include the consumption of washing substances in the dosing device 25, including the option that this dosing device 25 can be filled automatically without surveillance by the user 14 by any service personnel. This service personnel may receive the information to refill or replace the dosing device 25 from the receiver 39 itself, preferably automatically. The user 14 may then be informed via e-mail or the like and only needs to give access for the service personnel to the appliance 20. The same applies in a case where the receiver 39 has determined that a repair or maintenance is necessary, for example in one of the valves V or any other functional unit such as a sensor S or the pump 28, for example.

Similar actions may include a decalcification of any functional parts in the appliance 20, for example in the pump 28. Due to its integrated heating element and heating function, this is particularly vulnerable for calcification and negative impact on its function. Such a need for decalcification can be detected in the digital twin appliance data object by the receiver 39, and the user 14 can be notified via the user interface UI to initiate a decalcification process. Alternatively, it is initiated automatically and performed by the appliance controller 27. A respective informational message may be provided to the user 14 via the user interface UI.

Furthermore, any use of the appliance 20 which does not comply with any user guidelines agreed to by the user 14, or which can even be detrimental to the appliance 20 can be detected. This can for example lead to additional charges to the user 14 or, alternatively, to try to teach the user 14 via the user interface UI to handle the appliance 20 with more care and according to the user instructions and/or user guidelines.

A further advantage of example embodiments is also for the receiver 39 to have a detailed and complete picture of the use history of the appliance 20 and, especially, of each appliance 20 that has been lent out to a user. This allows for the receiver 39 to have more accurate information about the state of the appliance 20 when it may be returned by the user 14, for example to determine its commercial value and a potential further future use of it. Furthermore, it is easier to service such a returned washing machine more accurately before lending it out to the next user.

As the receiver 39 preferably also has all detailed information about the appliance 20 in its new and theoretically optimal state, such a determination of the actual state of the washing machine after having been used with all the data present in the receiver 39 and the digital twin appliance data object, respectively, allows for better assessment of the washing machine and its state.

FIG. 4 is an overview of a system that can be used to practice certain embodiments described herein, and should not be considered limiting. As illustrated in FIG. 4, example embodiments may be implemented as or employed in a distributed system, and/or some components may be implemented within a cloud-based network. The various depicted components may be configured to communicate over a network 38, such as the Internet, for example, or any other communication interface, such as but not limited to a cloud computing interface. The receiver 39 may be communicatively connected to any number of appliances 20-20*n*, to receive, process, and analyze operating data from the respective appliances 20. The receiver 39 may further access a database 50 to obtain manufacturer related data, such as but not limited to component types and/or subsystems of particular appliance models. The database 50 may additionally or alternatively include historical maintenance and/or repair records, and/or the like, relating to appliances 20. A user device 90 may optionally be included to interact with any of the receiver 39 and/or appliance 20. For example, messages regarding recommended maintenance, cleaning and/or repair may be provided via a user device 90 to a user of the appliance 20 and/or associate of a leasing or repair company, for example.

The system of FIG. 4 described above is provided merely as an example implementation and it will be appreciated that the example embodiments provided herein may be implemented as or employed by any number of system architectures.

Referring now to FIG. 5, apparatus 200 is a computing device(s) that at least partially or wholly embodies any of the appliance 20, user device 90, receiver 39, and/or database 50.

Apparatus 200 may include or otherwise be in communication with a processor 210, user interface 212, communication interface 214, and memory 216. As describe above, apparatus 200 may be implemented as a distributed system for performing the operations described herein. As such, any of the components such as the processor 210, user interface 212, communication interface 214, and memory 216, or portion(s) thereof, may be distributed across multiple computing devices and may be collectively configured to operate as apparatus 200. As such, the various operations described herein may indeed be performed by different computing devices.

The processor 210 may, for example, be embodied as various means including one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an ASIC (application specific integrated circuit) or FPGA (field programmable gate array), or some combination thereof. Accordingly, although illustrated in FIG. 5 as a single processor, in some embodiments processor 210 comprises a plurality of processors. The plurality of processors may be embodied on a single computing device, such as server and/or receiver, or may be distributed across a plurality of computing devices collectively configured to function as the processor 210. The plurality of processors may be in operative communication with each other and may be collectively configured to perform one or more functionalities as described herein. In an example embodiment, processor 210 is configured to execute instructions stored in memory 216 or otherwise accessible to processor 210. These instructions, when executed by processor 210, may cause the apparatus 200 to perform one or more of the functionalities as described herein.

Whether configured by hardware, firmware/software methods, or by a combination thereof, processor 210 may comprise an entity capable of performing operations according to the example embodiments described herein. Thus, for example, when processor 210 is embodied as an ASIC, FPGA or the like, processor 210 may comprise specifically configured hardware for conducting one or more operations described herein. Alternatively, as another example, when processor 210 is embodied as an executor of instructions, such as may be stored in memory 216, the instructions may specifically configure processor 210 to perform one or more algorithms and operations described herein.

Memory 216 may comprise, for example, volatile memory, non-volatile memory, or some combination thereof. Although illustrated in FIG. 5 as a single memory, memory 216 may comprise a plurality of memory components. The plurality of memory components may be embodied on a single computing device or distributed across a plurality of computing devices. Memory 216 may include database 50, for example, and/or any memory components of appliance 20, user device 90, and/or receiver 39. In various embodiments, memory 216 may comprise at least a non-transitory medium such as but limited to a hard disk, random access memory, cache memory, flash memory, a compact disc read only memory (CD-ROM), digital versatile disc read only memory (DVD-ROM), an optical disc, circuitry configured to store information, or some combination thereof. Memory 216 may be configured to store information, data (including XML files, database tables, etc.), applications, instructions, or the like for enabling apparatus 200 to carry out various functions in accordance with example embodiments described herein. For example, in at least some embodiments, memory 216 is configured to buffer input data for processing by processor 210. Additionally or alternatively, in at least some embodiments, memory 216 is configured to store program instructions for execution by processor 210. Memory 216 may store information in the form of static and/or dynamic information. This stored information may be stored and/or used by apparatus 200 during the course of performing its functionalities.

Communication interface 214 may be embodied as any device or means embodied in circuitry, hardware, a computer program product comprising computer readable program instructions stored on a computer readable medium (e.g., memory 216) and executed by a processing device (e.g., processor 210), or a combination thereof that is configured to receive and/or transmit data from/to another device and/or network, such as, for example, a second apparatus 200 and/or the like. In some embodiments, communication interface 214 (like other components discussed herein) can be at least partially embodied as or otherwise controlled by processor 210. In this regard, communication interface 214 may be in communication with processor 210, such as via a bus. Communication interface 214 may include, for example, an antenna, a transmitter, a receiver, a transceiver, network interface card and/or supporting hardware and/or firmware/software for enabling communications with another local or remote computing device and/or servers. Communication interface 214 may include a network (e.g., network 10), such as any wired or wireless communication network including a local area network (LAN), personal area network (PAN), wide area network (WAN), the Internet, an intranet, or the like, as well as any attendant hardware, software and/or firmware required to implement said networks (e.g., network routers and network switches). Communication interface 214 may be configured to receive and/or transmit any data that may be provided by appliance 20, for example, using any protocol that may be used for communications between computing devices. Communication interface 214 may be further configured, for example, to write data to database 50. Communication interface 214 may additionally or alternatively be in communication with the memory 216, user interface 212 and/or any other component of apparatus 200, such as via a bus.

An optional user interface 212, such as the user interface UI of FIG. 1, may be in communication with processor 210 to receive an indication of a user input and/or to provide an audible, visual, mechanical, or other output to a user. As such, user interface 212 may include, for example, a keyboard, a mouse, a user device, a computer, a display, and/or other input/output mechanisms. In embodiments in which apparatus 200 is embodied as a distributed system, user interface 212 may be implemented on a user device, such as user device 90, that may be separate from the receiver 39 and/or appliance 20, but in communication therewith. In certain embodiments, the user interface 212 may be implemented on appliance 20, such as user interface UI of FIG. 1. One or more than one user interfaces 212 can be included in apparatus 200 and in various components of the system.

FIG. 6 is a flowchart of operations that may be performed according to example embodiments, such as apparatus 200 and/or receiver 39, for generating and training one or more machine learning models. In operation 600, apparatus 200 embodied by receiver 39, includes means, such as communication interface 214, processor 210 and memory 216, for receiving training operating data from a plurality of appliances.

Operating data from various appliances 20 may be transmitted over the network to the receiver 39 and stored in memory 216. The data may be stored in memory 216 and/or database 50. The data may be transmitted as a part of routine data transmission process and/or predetermined schedule, such as one required by an owner of the appliance when the appliance 20 is leased to a user, for example. As another example, the operating data may be transmitted when a predefined condition or error scenario is detected on the appliance 20, such as one detected by one or more sensors.

Operating data may therefore be compiled and stored for subsequent access by the receiver 39, creating a log of historical operating data for specific appliances 20. The operating data may be referred to as training operating data as it is used to generate and train a machine learning model as described in further detail below. The training operating data may be associated with at least one of a water inlet, a temperature sensor, or a dosing device of the appliance or other component described herein. The training operating data may include a number of treatment operations, a rate of treatment operations, a detergent consumption indicator, a type of a cleaning operation, an ambient temperature, a water hardness indicator, a water temperature and/or the like.

In operation 602, apparatus 200 embodied by receiver 39, includes means, such as processor 210 and memory 216, for generating one or more models by correlating respective training operating data with respective manufacturer data, and at least one outcome comprising at least one of a cleaning indicator, a repair indicator, a damage indicator, a cleaning indicator for cleaning the appliance, an error, or a life expectancy. Outcomes may be defined or captured in a variety of ways. In certain embodiments, the at least one outcome may be included in the training operating data and is extracted and/or identified by processor 210 of receiver 39. In certain embodiments, the at least one outcome may be received by receiver 39, such as by entry of maintenance and/or repair information via a user interface 212. For example, a system utilized by customer service may facilitate user provision of information related to maintenance, repairs, damages, instances in which an appliance is determined to reach the end of its working life, and/or the like. Such information relating to outcomes may be stored in association with the training data, such that database 50 includes a historical operating log, and at least one outcome such as a repair indicator, damage indicator, an error, or life expectancy. The training operating data may be correlated or associated with manufacturer data such as a make and model, date of manufacture, and/or the like, obtained from database 50 and/or the like. The machine learning model incorporates the training operating data and optionally data associated therewith, such as manufacturer data and/or outcome data, and may be generated according to any machine learning framework. For example, the data may be configured as one or more neural networks, or other type of machine learning model(s).

In operation 604, apparatus 200 embodied by receiver 39, includes means, such as processor 210 and memory 216, for training the one or more machine learning models to learn patterns in the training operating data that impact the respective outcomes. For example, in certain embodiments the outcomes stored in association with the training operating data may be used as labels to perform supervised machine learning. In certain embodiments, unsupervised machine learning may be performed on training operating data to cluster and identify significant outcomes and their associated patterns in operating data. The machine learning algorithm may be implemented according to any known framework, and/or configured by the receiver 39, such as configured for use with appliances and/or to certain appliance types, to learn patterns in the training operating data and predict outcomes based on operating data. For example, one or more machine learning models may be generated and trained to predict an average life expectancy of an appliance, an estimated optimal time to perform a certain maintenance routine(s), a maintenance program, a cleaning schedule and/or program, frequency and/or specific parameters of the self-cleaning/maintaining program, a recommendation for replacement of a certain part or component, a lifespan of a certain part or component, an estimated time for damage of a certain part or component, and/or the like.

The training data, and/or input to the machine learning model either during training and/or execution of the model to perform one or more predictions may include any data collected according to example embodiments such as but not limited to internal machine data, water level, temperature, power consumption, door lock, moisture level, turbidity, stain type and soiling degree. The training data and/or input to the model may further include usage data such as but not limited to cycle time, programs used, frequency of use, detergent, textile, user preferences. The training data and/or input to the model may further include third party data, such as but not limited to weather, water pH Level, weather climate, and energy management.

FIG. 7 is a flowchart of operations that may be performed according to example embodiments, such as apparatus 200 and/or receiver 39, for utilizing one or more trained machine learning models and operating data from an appliance to generate a predictive maintenance data object. In operation 700, apparatus 200 embodied by receiver 39, includes means, such as communication interface 214, processor 210 and memory 216, for receiving operating data for the appliance, wherein the operating data for the appliance is automatically collected by the appliance, and is associated with at least one of a water inlet, a temperature sensor, or a dosing device of the appliance. Also a degree of soiling in the apparatus or washing machine can be taken into account, which can be detected via sensors or which can be input by a user. The operating data may include a number of treatment operations, a rate of treatment operations, a detergent consumption indicator, a type of cleaning operations, an ambient temperature, a water hardness indicator, a water temperature and/or the like. In certain embodiments, the operating data may include any data collected according to example embodiments such as but not limited to internal machine data, water level, temperature, power consumption, door lock, moisture level, turbidity, stain type and soiling degree. The operating data may further include usage data such as but not limited to cycle time, programs used, frequency of use, detergent, textile, user preferences, and/or third party data, such as but not limited to weather, water pH Level, weather climate, and energy management.

Operating data from appliance 20 may be transmitted over the network to the receiver 39 and stored in memory 216 and/or database 50. The data may be transmitted as a part of routine data transmission process and/or predetermined schedule, such as one required by an owner of the appliance when the appliance 20 is leased to a user, for example. As another example, the operating data may be transmitted when a predefined condition or error scenario is detected on the appliance 20, such as one detected by one or more sensors.

In operation 702, apparatus 200 embodied by receiver 39, includes means, such as processor 210 and memory 216, for generating a digital twin appliance data object based at least in part on the operating data and manufacturer data associated with the appliance. In this regard, the operating data received by the receiver 39 may be further associated with any other data, such as from database 50 that represents the appliance. The digital twin appliance data object may be stored in database 50 and may be optionally updated over time as additional operating data is received. The digital twin appliance data object may include or be associated with a unique identifier of the appliance such as a serial number or other identifier.

In operation 704, apparatus 200 embodied by receiver 39, includes means, such as processor 210 and memory 216, for generating, using one or more machine learning models, a predictive maintenance data object, wherein (a) the one or more machine learning model have been trained with training operating data from a plurality of appliances, and (b) the predictive maintenance data object describes a predicted outcome of the appliance based at least in part on the operating data. The predictive maintenance data object may therefore be generated to mitigate the predicted outcome of the appliance or increase a life expectancy of the appliance. In certain embodiments, the predictive maintenance data object comprises at least one of a cleaning schedule or maintenance program. The predictive maintenance data object may include textual instructions intended for a user, operator, or repair person. The predictive maintenance data object may include codes or other indicators of predefined recommendations relating to cleaning, maintenance, and/or repairs. In certain embodiments, the predictive maintenance data object includes codes or other indicators associated computer-executed instructions that automatically trigger a cleaning, maintenance and/or repair task to be performed at or by the appliance.

In certain embodiments, the predictive maintenance data object may reflect predicted wear and/or damages based on the operating data and conditions of an appliance. For example, after one year of use of the appliance, some kind of wear might be expected. This can also be simulated in the digital twin appliance data object and/or corresponding predictive maintenance data object, the influence of such wear determined according to the operating data received from the appliance.

In operation 706, apparatus 200 embodied by receiver 39, includes means, such as processor 210, communication interface 214, memory 216, and/or the like, for causing transmission of the predictive maintenance data object toward the appliance, wherein in response thereto, at least one maintenance task is at least one of automatically initiated by the appliance or communicated via a user interface. According to certain embodiments, the apparatus 200 may initiate application of the recommendations autonomously, or with the opt-in of the user.

In this regard, the predictive maintenance data object may result in display of information (such as but not limited to textual instructions) to a user interface of the appliance and/or user device, such as a user device 90 associated with appliance 20. In certain embodiments, the predictive maintenance data object may cause computer-executable code to trigger a maintenance task at the machine. For example, one or more water valves could be controlled to perform a cleaning cycle, and/or the like as described herein. In certain embodiments, computer-executable instructions configured in memory of the appliance may be invoked to perform an automated cleaning or maintenance task. In certain embodiments, computer-executable instructions are transmitted to the appliance in or with the predictive maintenance data object. In certain embodiments, the predictive maintenance data object may additionally or alternatively trigger a service call and/or a service visit to the location of the appliance. Numerous variations may be contemplated.

Example embodiments may therefore ensure certain repair and damage risks to appliances are mitigated efficiently and timely, and that the appliances are maintained as recommended to limit such risks. Embodiments of the present disclosure may improve or maximize appliance lifespans, reduce, or limit costly repairs, and/or limit the risk and exposure of related parts becoming damaged or inoperable due to misuse or insufficient cleaning and/or maintenance regimens.

Implementing and training the machine learning model using a computing system such as the receiver 39 provides many advantages and discovery of patterns and correlations between operating data and outcomes that may not otherwise be discovered. According to example embodiment utilizing machine learning models, large volumes of operating data can be efficiently and accurately processed and analyzed to discover recommended maintenance, repairs, cleaning, and/or the like, for certain makes, models, and/or even appliances comprising certain manufactured components. Ideal operating conditions can also be discovered, such as optimal temperatures, water hardness, and/or the like, the precision of which would be impractical or impossible to calculate by human methods, given the volume of data and difficulty of identifying correlations and patterns. Additionally, the multitude of variable conditions made possible in cleaning programs, such as but not limited to different chemistries of cleaning solutions, temperatures, time, and volume flow can be fine-tuned and particularly optimized for each appliance and respective operating conditions, by the disclosed machine learning models and methods disclosed herein, to determine optimal cleaning regimens and schedules.

Accordingly, such discoveries enabled by example embodiments and the corresponding generated predictive maintenance data object may be impractical or impossible to otherwise determine without the advantages of the present disclosure. Additionally, as new products, models, and components are brought to market, new data can be gathered and processed in real-time or near real-time, and efficiently, using the machine learning model(s) of receiver 39 to determine new patterns in the data and recommended maintenance, cleaning, repairs, and/or the like. It will be appreciated that the descriptions of machine learning models provided herein are non-limiting and that a variety of machine learning models and training algorithms may be used to make various types of predictions regarding an appliance based on its operating data and/or manufacturer data.

Implementing the data transmission of a subject appliance to the receiver 39 and processing the data with the machine learning model further enable efficient and real-time or near real-time risk mitigation with regard to appliance condition and operation. Individuals representing the owner of the appliances cannot efficiently or effectively visit sites to assess operating conditions, maintenance, and cleaning tasks. Entities leasing such appliances may therefore benefit from improved appliance lifespans, reduced repairs, and damages, and/or the like, with little or no human involvement. For example, in embodiments in which the predicted or recommended maintenance or cleaning is automatically triggered, the preventative measures can be completely automated with little or no human or user involvement.

Additionally, or alternatively, an entity owning an appliance may have a clear understanding of the condition of the appliances under its care and can plan for its return at the end of a lease and prepare for additional maintenance or repair recommendations, such as those that are not performed when the appliance is in the possession of the user, such as but not limited to replacing components of the appliance, and/or the like.

Embodiments of the present disclosure have been described above with reference to block diagrams and flowchart illustrations of methods, apparatuses, systems, and computer program products. It will be understood that each block of the circuit diagrams and process flowcharts, and combinations of blocks in the circuit diagrams and process flowcharts, respectively, can be implemented by various means including computer program instructions. These computer program instructions may be loaded onto a general-purpose computer, special purpose computer, or other programmable data processing apparatus, such as processor 210 discussed herein, to produce a machine, such that the computer program product includes the instructions which execute on the computer or other programmable data processing apparatus create a means for implementing the functions specified in the flowchart block or blocks.

These computer program instructions may also be stored in a computer-readable storage medium (e.g., memory 216) that can direct a computer or other programmable data processing apparatus to function in a particular manner, such that the instructions stored in the computer-readable storage medium produce an article of manufacture including computer-readable instructions for implementing the function discussed herein. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions discussed herein.

Accordingly, blocks of the block diagrams and flowchart illustrations support combinations of means for performing the specified functions, combinations of steps for performing the specified functions and program instruction means for performing the specified functions. It will also be understood that each block of the circuit diagrams and process flowcharts, and combinations of blocks in the circuit diagrams and process flowcharts, can be implemented by special purpose hardware-based computer systems that perform the specified functions or steps, or combinations of special purpose hardware and computer instructions.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for generating a maintenance data object for an appliance, the method comprising:

receiving, by one or more processors, operating data for the appliance, wherein the operating data for the appliance is automatically collected by the appliance, and is associated with at least one of a water inlet, a temperature sensor, or a dosing device of the appliance;

generating, by the one or more processors, a digital twin appliance data object based at least in part on the operating data and manufacturer data associated with the appliance; and generating, by the one or more processors and using one or more machine learning models, a predictive maintenance data object, wherein (a) the one or more machine learning models have been trained with training operating data from a plurality of appliances, and (b) the predictive maintenance data object describes a predicted outcome of the appliance based at least in part on the operating data.

2. The method of claim 1, wherein the training operating data comprises or is associated with at least one outcome comprising at least one of a repair, a damage indicator, an error, or a life expectancy, wherein the one or more machine learning models are trained to predict outcomes according to patterns in the training operating data that impact the respective outcomes, and wherein the predictive maintenance data object is generated to mitigate the predicted outcome of the appliance or increase a life expectancy of the appliance.

3. The method of claim 1, further comprising:

causing transmission of the predictive maintenance data object toward the appliance, wherein in response thereto, at least one maintenance task is at least one of automatically initiated by the appliance or communicated via a user interface.

4. The method of claim 1, further comprising:

receiving, via the network, the training operating data from the plurality of appliances;

generating the one or more machine learning models by correlating respective training operating data with respective manufacturer data, and at least one outcome comprising at least one of a cleaning indicator, a repair indicator, a damage indicator, an error, or a life expectancy; and training the one or more machine learning models to learn patterns in the training operating data that impact the respective outcomes.

5. The method of claim 1, wherein the predictive maintenance data object comprises at least one of a cleaning schedule or maintenance program.

6. The method of claim 1, wherein the operating data is received from the appliance according to a predetermined schedule.

7. The method of claim 1, wherein the operating data is received from the appliance in response to detection of at least one predefined condition being satisfied.

8. The method of claim 1, wherein the subject operating data comprises at least one of: a number of treatment operations, a rate of treatment operations, a detergent consumption indicator, a type of a cleaning operation, an ambient temperature, a water hardness indicator, or a water temperature.

* * * * *